US008047120B2

(12) United States Patent
Shinohara et al.

(10) Patent No.: US 8,047,120 B2
(45) Date of Patent: Nov. 1, 2011

(54) HYDRAULIC PISTON PUMP WITH A BALANCE VALVE

(75) Inventors: Shigeru Shinohara, Oyama (JP); Mitsuru Arai, Oyama (JP)

(73) Assignee: Komatsu Ltd., Tokyo (JP)

( * ) Notice: Subject to any disclaimer, the term of this patent is extended or adjusted under 35 U.S.C. 154(b) by 267 days.

(21) Appl. No.: 11/883,682

(22) PCT Filed: Feb. 8, 2006

(86) PCT No.: PCT/JP2006/302157

§ 371 (c)(1),
(2), (4) Date: Aug. 3, 2007

(87) PCT Pub. No.: WO2006/085547

PCT Pub. Date: Aug. 17, 2006

(65) Prior Publication Data

US 2008/0138225 A1 Jun. 12, 2008

(30) Foreign Application Priority Data

Feb. 10, 2005 (JP) ..... 2005-034863

(51) Int. Cl.

| | |
|---|---|
| ***F01B 3/02*** | (2006.01) |
| ***F01B 3/10*** | (2006.01) |
| ***F04B 1/12*** | (2006.01) |
| ***F04B 11/00*** | (2006.01) |

(52) U.S. Cl. ..... 91/6.5; 417/269; 417/540; 91/499

(58) Field of Classification Search ..... 417/270, 417/269, 271, 499, 540, 542; 91/6.5, 499, 91/503, 485; 92/71, 12.2

See application file for complete search history.

(56) References Cited

U.S. PATENT DOCUMENTS

| | | | | |
|---|---|---|---|---|
| 2,642,809 | A * | 6/1953 | Born et al. | 91/6.5 |
| 2,963,983 | A * | 12/1960 | Wiggermann | 91/6.5 |
| 3,037,489 | A * | 6/1962 | Douglas | 91/485 |
| 3,180,274 | A * | 4/1965 | Sisk | 91/6.5 |
| 3,199,461 | A * | 8/1965 | Wolf | 91/6.5 |
| 3,585,901 | A * | 6/1971 | Moon et al. | 91/6.5 |

(Continued)

FOREIGN PATENT DOCUMENTS

CN 1235363 11/1999

(Continued)

OTHER PUBLICATIONS

Machine Translation of JP10115282A.*

(Continued)

*Primary Examiner* — Devon C Kramer
*Assistant Examiner* — Nathan Zollinger
(74) *Attorney, Agent, or Firm* — Fish & Richardson P.C.

(57) ABSTRACT

In a hydraulic piston pump, a cylinder port can communicate with a discharge port after a system pressure and a chamber pressure in a cylinder bore becomes in an equilibrium condition. A through hole opening to a surface on which a cylinder block slides in a valve plate is allowed to communicate with a side of one end surface of a balance valve, and the system pressure of a discharge port side is supplied to the other end surface of the balance valve. In the balance valve, a balance piston which slides by a pressure difference between the chamber pressure of the cylinder bore and the system pressure is accommodated. Before the cylinder port communicates with an oil guiding groove, the chamber pressure can be equilibrated to the system pressure by an activation of the balance piston.

12 Claims, 11 Drawing Sheets

U.S. PATENT DOCUMENTS

| | | | | | |
|---|---|---|---|---|---|
| 3,604,314 | A | * | 9/1971 | Steiner | 91/485 |
| 3,956,969 | A | * | 5/1976 | Hein | 91/6.5 |
| 4,034,652 | A | * | 7/1977 | Huebner | 91/499 |
| 4,048,903 | A | * | 9/1977 | Roberts | 91/6.5 |
| 4,096,786 | A | | 6/1978 | Schauer | |
| 4,175,472 | A | * | 11/1979 | Roberts | 91/6.5 |
| 4,920,856 | A | * | 5/1990 | Berthold et al. | 91/6.5 |
| 5,555,726 | A | * | 9/1996 | Huebner | 60/469 |
| 5,572,919 | A | * | 11/1996 | Ishizaki | 91/499 |
| 5,807,080 | A | * | 9/1998 | Ochiai et al. | 417/269 |
| 6,086,336 | A | * | 7/2000 | Welschof et al. | 417/308 |
| 6,116,871 | A | * | 9/2000 | Backe et al. | 417/540 |
| 6,435,072 | B2 | | 8/2002 | Hirano et al. | |
| 6,497,172 | B2 | | 12/2002 | Hirano et al. | |
| 6,736,048 | B2 | * | 5/2004 | Riedhammer et al. | 91/504 |
| 2002/0108489 | A1 | | 8/2002 | Riedhammer et al. | |

FOREIGN PATENT DOCUMENTS

| | | | | |
|---|---|---|---|---|
| DE | 100 34 857 | | | 1/2002 |
| JP | 55-152369 | | | 11/1980 |
| JP | 55152369 | U | * | 11/1980 |
| JP | 4-111575 | | | 9/1992 |
| JP | 4111575 | U | * | 9/1992 |
| JP | 9-317627 | | | 12/1997 |
| JP | 10-115282 | | | 5/1998 |
| JP | 10115282 | A | * | 5/1998 |
| JP | 2001-248606 | | | 9/2001 |
| WO | WO 97/22805 | | | 6/1997 |

OTHER PUBLICATIONS

Machine Translation of JP4111575U.*
Human English Translation of JP55152369U.*
Exner et al., "Mannesmann Rexroth Hydraulik Trainer 1, 2", Edition, 1991, vol. 1, pp. 140-141.

* cited by examiner (a)

(b)

PRIOR ART

HYDRAULIC PISTON PUMP WITH A BALANCE VALVE

TECHNICAL FIELD

The present invention relates to a hydraulic piston pump.

BACKGROUND ART

Conventionally, as a hydraulic piston pump, an axial piston pump has been widely employed as a fixed capacity type pump or a variable capacity type pump.

In general, in a hydraulic piston pump, oil is, in an absorption process, absorbed from an absorption port of a valve plate into a cylinder bore through a cylinder port of a cylinder bore formed in a cylinder block. Further, in a discharge process, pressure oil in the cylinder bore is discharged into a discharge port of the valve plate through a cylinder port. The discharged pressure oil is supplied to a hydraulic pressure system having a specific system pressure, an actuator, or the like.

In an area in which the cylinder port is switched from the absorption port to the discharge port, a chamber pressure of the cylinder bore is an absorption pressure until the time when the cylinder port is at a position corresponding to a bottom dead center of a piston inside the cylinder bore. In a pre-compression section between the absorption port and the discharge port, the piston slides from the bottom dead center toward a top dead center, and the chamber pressure of the cylinder bore is increased so that the pressure is increased to a pressure close to the system pressure. Thereafter, the cylinder port is coupled with the discharge port, so that the pressure oil inside the cylinder bore is discharged into the discharge port with compression by the piston.

In the pre-compression section, a pressure increment amount by which the chamber pressure of the cylinder bore is increased is constant. Thus, when the system pressure in the hydraulic pressure system or the like to which the pressure oil is supplied from the discharge port changes, oil pressure at the discharge port, that is, the system pressure, changes. When the cylinder port is coupled with the discharge port in this state, a pressure difference between the chamber pressure of the cylinder bore which corresponds to the system pressure before the change and the system pressure after the change becomes large, so that pressure change inside the cylinder bore becomes drastic. This becomes a cause of vibration and noise in the hydraulic piston pump. The vibration and noise generated in the hydraulic piston pump adversely affect operational environment.

As a method to prevent this, the pre-compression section is decreased in some cases. In such cases, however, backflow of the system pressure into the cylinder bore occurs, and erosion may be generated in the cylinder bore, and/or cavitation may be generated to cause vibration and noise.

As pumps in which vibration and noise are prevented without decreasing the pre-compression section, there have been proposed a hydraulic pump in which first and second conduits are formed on a pre-expansion section in which the discharge port is switched to the absorption port and the pre-compression section, respectively, so that the respective conduits communicate with each other through a check valve (see Patent document 1) and a low noise hydraulic pump in which a check valve timing device is provided on the pre-compression section (see Patent document 2).

The hydraulic pump disclosed in the Patent document 1 is configured, as shown in FIG. 14, such that a first conduit 44 is formed on a pre-expansion section θ1 on a valve plate 40, and a second conduit 45 is formed on a pre-compression section θ2. An opening position of the first conduit 44 is formed on a portion at which a cylinder port 43 of a cylinder bore formed in a cylinder block communicates with the first conduit 44 and is formed at a position immediately before the cylinder port 43 communicates with an absorption port 41.

An opening position of the second conduit 45 is formed on a portion at which a cylinder port 43 communicates with the second conduit 45 and is formed at a position immediately after the cylinder port 43 is disconnected from the absorption port 41. The first conduit 44 and the second conduit 45 are coupled with an accumulator 50 through check valves 46, 47, respectively. The check valve 46 allows flow from the first conduit 44 side to the accumulator 50, and the check valve 47 allows flow from the accumulator 50 to the second conduit 45 side.

When the cylinder port 43 finishes the communication with a discharge port 42 and enters the pre-expansion section θ1, the chamber pressure inside the cylinder bore is decreased. When the cylinder port 43 communicates with the first conduit 44, pressure oil inside the cylinder bore whose pressure is decreased in the pre-expansion section θ1 enters the accumulator 50 through an oil path 48 and the check valve 46. The chamber pressure inside the cylinder bore is further decreased, while the pressure inside the accumulator 50 is increased to the chamber pressure inside the cylinder bore. Thus, the pressure difference between the chamber pressure inside the cylinder bore and the absorption pressure of the absorption port 41 can be decreased.

When the cylinder port 43 ends the communication with the absorption port 41 and the piston reaches the bottom dead center, the cylinder port 43 communicates with the second conduit 45. At this time since the chamber pressure inside the cylinder bore is the absorption pressure, the pressure oil inside the accumulator 50 enters the cylinder bore through an oil path 49, the check valve 47, and the second conduit 45 to increase the chamber pressure inside the cylinder bore.

Consequently, the pressure difference between the chamber pressure inside the cylinder bore and the system pressure of the discharge port 42 is decreased. When the cylinder port 43 communicates with a throttle path 42*a*, the flow rate from the discharge port 42 into the cylinder bore is decreased, so that pulsating due to the discharge flow rate can be decreased.

The low noise hydraulic pump disclosed in the Patent document 2 is formed so as to have such a constitution shown in FIG. 15. FIG. 15 shows a perspective view partly broken away of a valve plate 60 in which a communication hole 64 is formed in a pre-compression section provided between an absorption port 61 and a discharge port 62 and in which a check valve 66 is incorporated in the communication hole 64. A check valve chamber 65 is formed in a lower end side of the communication hole 64. The inner diameter of the check valve chamber 65 is formed so as to be slightly larger than the outer diameter of the check valve 66 such that the check valve 66 is reciprocatable inside the check valve chamber 65.

The check valve chamber 65 has an opening on a check valve pocket 67 formed on a matching face of a valve block 68 of the hydraulic pump. The check valve pocket 67 is formed so as to be smaller than the check valve chamber 65 such that the check valve 66 stays along the surface of the valve block 68. A pressure oil path 69 communicating with the check valve pocket 67 is formed inside the valve block 68 and communicates with the discharge port 62.

The check valve 66 is formed of a thin disk having a plurality of holes 70 positioned about a center hole 71 of the disk. These holes 70, 71 are respectively formed such that a desired amount of flow is made to pass through a check valve assembly 63.

When the cylinder port of a cylinder bore is spaced apart from the absorption port 61, the cylinder port immediately communicates with the communication hole 64. The chamber pressure in the cylinder port at this position is lower than the system pressure in the discharge port 62. Thus, the pressure oil in the discharge port 62 enters through the path 69 to allow the check valve 66 to press the valve plate 60.

At this time, the holes 70 formed having the same center are closed, and the pressure oil entering through the path 69 is introduced into the cylinder bore through the central hole 71. Thus, by the pressure oil introduced through the communication hole 64, the chamber pressure in the cylinder bore is increased.

When a piston is pressed by means of a cam plate or the like to be lowered during rotation of the cylinder block, the chamber pressure in the cylinder bore increases. When the chamber pressure exceeds the system pressure in the discharge port 62, the pressure oil in the cylinder bore presses the check valve 66 downwardly. At this time, the pressure oil entering the check valve chamber 65 from the cylinder bore through the communication hole 64 can pass all of the holes 70, 71 and enter the check valve pocket 67.

Thus, a large amount of pressure oil can enter the discharge port 62, and when the cylinder port and the discharge port 62 communicate with each other, the chamber pressure in the cylinder bore can be equal to the system pressure in a steady flow rate state.

Patent document 1: Japanese Patent Application Laid-open No. 9-317627

Patent document 2: WO 97/22805

DISCLOSURE OF THE INVENTION

Problem to Be Solved by the Invention

In the hydraulic pump disclosed in the Patent document 1, pressure regulation is not performed between the chamber pressure of when the cylinder port 43 communicates with the discharge port 42 and the system pressure that is the pressure of the discharge port 42.

Thus, when the system pressure of the discharge port 42 is changed, a pressure difference is generated between the chamber pressure and the system pressure. Due to this pressure difference, backflow of pressure oil from the discharge port into the cylinder bore occurs to generate bubbles, pulsating pressure, and/or noise.

The low noise hydraulic pump disclosed in the Patent document 2 has a constitution in which the pressure oil of the discharge port 62 constantly enters the cylinder bore through the check valve assembly 63. Thus, when the system pressure is high, the high pressure oil enters the cylinder bore from the hole 71 to prevent the operation of the piston in the cylinder bore and to generate fine bubbles in the cylinder bore or pulsating pressure, thereby causing vibration and noise.

The present invention is to solve such a problem in the prior art, and it is an object of the present invention to provide a hydraulic piston pump capable of preventing generation of bubbles in a cylinder bore, pulsating of oil pressure and the like, the hydraulic piston pump allowing a cylinder port to communicate with a discharge port after a system pressure and a chamber pressure in the cylinder bore are in an equilibrium condition.

Means for Solving the Problems

Problems of the present invention can be resolved by respective inventions described in claims 1 to 5.

That is, according to the first invention of the present application, there is provided a hydraulic piston pump comprising: a valve plate having an absorption port and a discharge port which communicate with an absorption path and a discharge path of a pump case respectively; a cylinder block which slides on the valve plate to rotate; a plurality of cylinder bores formed in the cylinder block; and pistons which slide in the respective cylinder bores to do reciprocating motion in response to a rotation angle of the respective cylinder bores, being mainly characterized in that the hydraulic piston pump includes: a through hole formed between the absorption port in the valve plate and an oil guiding groove or an oil guiding tube or a timing hole of the discharge port to introduce a chamber pressure in the cylinder bore; a first oil path for introducing pressure oil of the chamber pressure from the through hole; a second oil path for introducing pressure oil of a system pressure from the discharge port; and a balance piston having one end surface that receives pressure oil from the first oil path and the other end surface that receives pressure oil from the second oil path.

Further, the second invention of the present application is mainly characterized in that the constitution of the balance piston is specified in the constitution of the first invention.

Moreover, the third and forth inventions of the present application are mainly characterized in that return mechanisms of the balance piston are specified in the constitutions of the first and second inventions, respectively.

Furthermore, the fifth invention of the present application is mainly characterized in that damper mechanisms are formed on the respective end surfaces of a balance valve for accommodating the balance piston in any of the constitutions of the first to forth inventions.

Effect of the Invention

In the present invention, before the cylinder bore communicates with the oil guiding groove or the oil guiding tube or the timing hole of the discharge port, the balance piston is activated in response to the pressure difference between the chamber pressure in the cylinder bore and the system pressure in the discharge port. With this actuation of the balance piston, the chamber pressure can be equilibrated to the system pressure.

Further, when the cylinder bore communicates with the discharge port, the chamber pressure and the system pressure are in an equilibrium condition. This makes it possible to prevent pulsating of pressure oil from occurring between the cylinder bore and the discharge port, and to reduce generation of noise and vibration in the hydraulic piston pump.

BRIEF DESCRIPTION OF THE DRAWINGS

Figure 1:
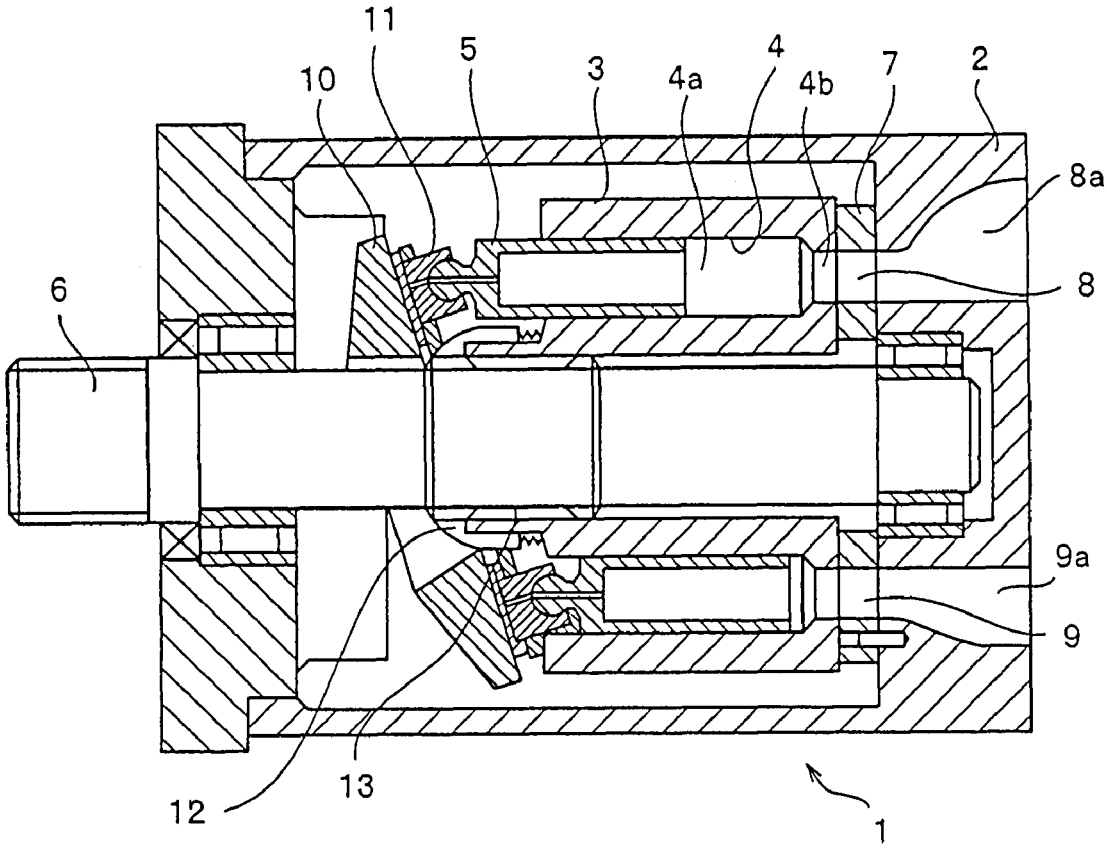
FIG. 1 is a cross-sectional view of a hydraulic piston pump (an embodiment).

4 . . . cylinder bore
4*b* . . . cylinder port
7 . . . valve plate
8 . . . absorption port
9 . . . discharge port
15 . . . oil guiding groove
16 . . . through hole
17 . . . timing hole
20 . . . balance valve
21 . . . balance piston
26 . . . first oil path
27 . . . second oil path
30 . . . balance valve
31 . . . balance piston
33 . . . balance valve
35 . . . balance piston
36 . . . damper mechanism
37 . . . damper mechanism
40 . . . valve plate
41 . . . absorption port
42 . . . discharge port
43 . . . cylinder port
44 . . . first conduit
45 . . . second conduit
46, 47 . . . check valve
60 . . . valve plate
61 . . . absorption port
62 . . . discharge port
63 . . . check valve assembly
65 . . . check valve chamber
66 . . . check valve
θ1 . . . pre-expansion section
θ2 . . . pre-compression section

BEST MODE FOR CARRYING OUT THE INVENTION

Preferred embodiments of the present invention will be described specifically below with reference to the accompanying drawings. In the description below, a cam plate type, axial type hydraulic piston pump is exemplified as a hydraulic piston pump. The present invention can be appropriately applied even to a pump of an inclined shaft type, axial type hydraulic piston pump or the like.

The constitution of a hydraulic piston pump itself according to the present invention does not correspond to a characteristic of the present invention, and the constitution of a hydraulic piston pump which has been employed conventionally can be appropriately adopted. Also, with respect to the constitution having a characteristic of the present invention, constitutions other than those described below can be adopted as long as they can solve problems of the present invention. Thus, the present invention is not limited to the constitutions of embodiments described below, and various modifications are possible.

In order that characteristics of the present invention can be easily understood, vertical-to-horizontal ratios of sizes in the respective drawings are different from real ones and are shown in exa ggerated proportions.

First Embodiment

FIG. 1 is a view showing a constitution of a hydraulic piston pump in order to describe a constitution with a characteristic of the present invention. FIG. 1 shows one example of a cam plate type axial piston pump which has been conventionally used. A hydraulic piston pump 1 has a rotation shaft 6 rotatably supported on a casing 2 through a bearing and a cylinder block 3 rotatably supported on the casing 2. The cylinder block 3 rotates integrally with the rotation shaft 6 by means of a spline 13, a key groove, or the like.

A plurality of cylinder bores 4 are formed on a single circumference whose center corresponds to the rotation axis in the cylinder block 3, and a piston 5 is slidably fitted into each cylinder bore 4. An end surface of the cylinder block 3 is slidably in contact with a surface of a valve plate 7. A shoe 11 is rotatably attached to the distal end of the piston 5 which slides inside the cylinder bore 4, and the shoe 11 can slide on a cam plate 10 while its sliding direction is restricted by a retainer 12. The shoe 11 slides on the cam plate 10, so that the piston 5 performs a stroke movement inside the cylinder bore 4.

A state in which the piston 5 is pulled maximum from the cylinder bore 4 so that the volume of a cylinder chamber 4*a* becomes maximum corresponds to a bottom dead center in the stroke movement of the piston 5, and a state in which the piston 5 is pushed into the cylinder bore 4 so that the volume of the cylinder chamber 4*a* becomes minimum corresponds to a top dead center in the stroke movement of the piston 5.

An absorption port 8 and a discharge port 9 which can selectively communicate with a cylinder port 4*b* formed on a bottom portion of the cylinder bore 4 when the cylinder block 3 rotates are arc shaped respectively on the valve plate 7. The absorption port 8 communicates with an absorption mouth 8*a* formed on the casing 2, and the absorption mouth 8*a* is connected with a hydraulic tank or the like. The discharge port 9 communicates with a discharge mouth 9*a* formed on the casing 2, and the discharge mouth 9*a* is connected with a hydraulic system, an actuator, and the like.

Figure 2:
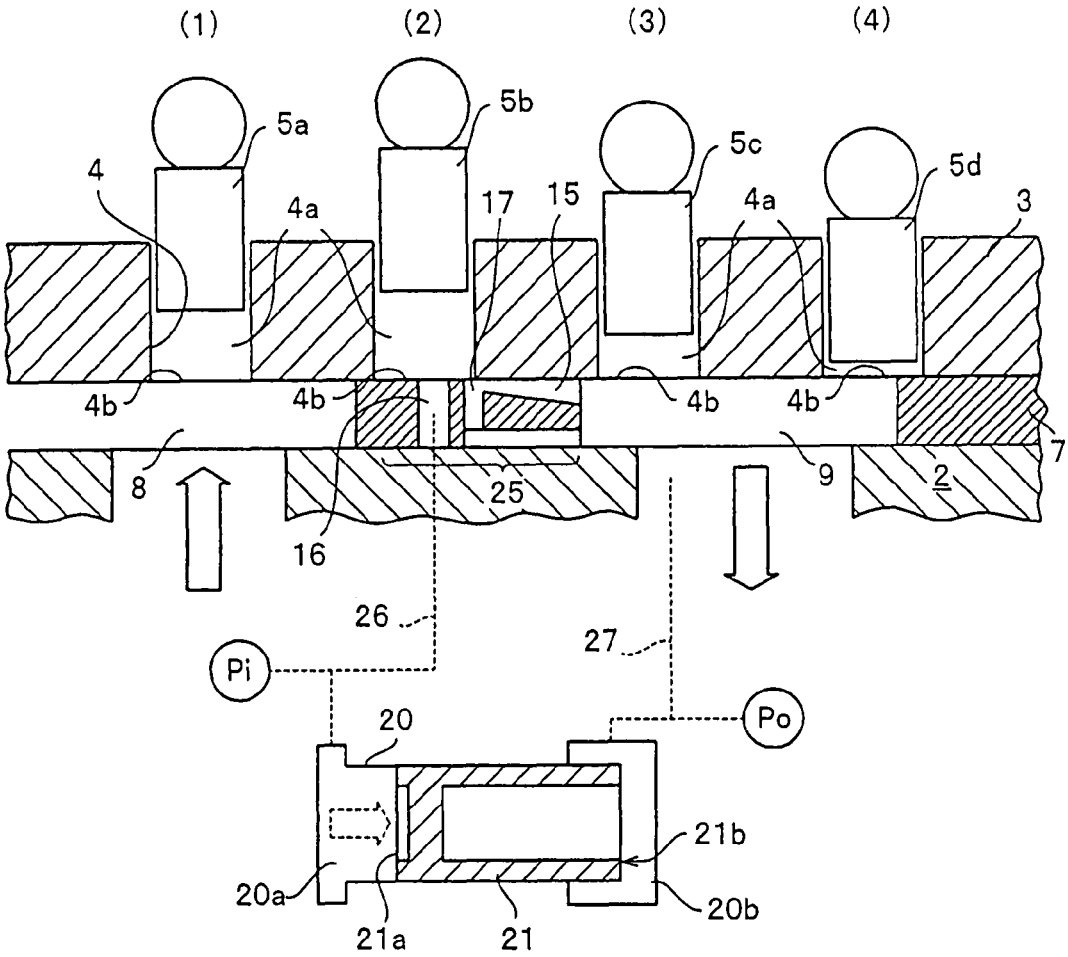
FIG. 2 is a developed view of a valve plate and a cylinder block (First embodiment).

FIG. 2 shows a schematic view in which a balance valve 20 is coupled to a view in which the valve plate 7 and the cylinder block 3 are developed. The piston 5 positioned at 5*a* is in an absorption stroke in which it communicates with the absorption port 8, and the piston 5 located at 5*b* is in a pre-compression section 25. The drawing shows that the pistons positioned at 5*c* and 5*d* are in a discharge stroke in which they communicate with the discharge port 9. The drawing shows that the piston 5 located at 5*b* is in a state in which parts of the cylinder port 4*b* communicate with a timing hole 17 and a through hole 16.

The cylinder block 3 moves from the left side in the drawing to the right direction, so that the piston 5 positioned at 5*a* moves to the positions 5*b*, 5*c* and 5*d* consecutively. At this time, the piston 5 which is not shown in the drawing and which is in a left side compared to the position 5*a* moves from the position 5*a* to the positions 5*b*, 5*c* and 5*d* consecutively.

The through hole 16 is a through hole opened to a sliding surface of the cylinder block 3 on the valve plate 7, and the other end portion thereof communicates with a one end surface side of the balance valve 20 through a first oil path 26. One end portion of the timing hole 17 is opened to the sliding surface of the cylinder block 3, and the other end portion thereof communicates with the discharge port 9.

The timing hole 17 is a hole formed on an end of an oil guiding groove 15 or an oil guiding tube which is formed in such a way that the chamber pressure in the cylinder bore 4 pressured in the pre-compression section does not enter the discharge port abruptly, and communicates with the discharge port 9. With this configuration, the formation position of the timing hole 17 is set in such a way that the cylinder port 4*b* and the timing hole 17 communicate with each other at predetermined timing.

In the present invention, formation of the timing hole 17 is not specifically necessary. However, since the timing hole 17 can be formed as a drilled hole, the timing hole 17 can be easily formed at a precise position at which the timing hole can be in exact synchronization with the cylinder port 4*b*.

On the other hand, in a case where the timing hole 17 is not formed and the end position of the oil guiding groove 15 is at a timing position at which the timing hole can be exact synchronization with the cylinder port 4*b*, an end position of the oil guiding groove 15 has to be made at a precise position at which the end position can be exact synchronization with the cylinder port 4*b*. However, if the groove is made in a state in which the end position of the oil guiding groove 15 is not at the correct position in the process of making the oil guiding groove 15, communication with the cylinder port 4*b* is not synchronized.

Thus, a highly skilled technique is needed in order to form the groove in such a way that the end position of the oil guiding groove 15 is at the correction position. In a case where the timing hole is formed, on the other hand, there is an advantage that the oil guiding groove 15 can be formed with not so high processing accuracy.

A balance piston 21 constructed as a free piston is slidably incorporated on the balance valve 20. A system pressure of the discharge port 9 side, that is, a load pressure of a hydraulic system, an actuator, or the like, which is coupled with the discharge port 9, affects in the other end side of the balance valve 20 via a second oil path 27. The system pressure changes due to fluctuation in the load pressure of a hydraulic system, an actuator, or the like, which is coupled with the discharge port 9.

The system pressure in the present invention means an oil pressure in the discharge path in a pump case of the hydraulic piston pump 1.

Here, suppose a chamber pressure Pi in the cylinder bore 4 is higher than a system pressure Po in the discharge port 9 in the pre-compression section 25, pressure oil in the cylinder bore 4 enters a first pressure chamber 20*a* of the balance valve through the through hole 16 and the first oil path 26, and presses an end portion 21*a* of the balance piston 21 to slide the balance piston 21 to a right direction of FIG. 2. By sliding of the balance piston 21 to the right direction, the volume of the first pressure chamber 20*a* increases, so that the chamber pressure Pi in the cylinder bore 4 can be decreased.

The balance piston 21 slides until the chamber pressure Pi and the system pressure Po are equilibrated, and the balance piston 21 stops sliding in a state in which the chamber pressure Pi and the system pressure Po are in an equilibrium condition. In this state, the cylinder port 4*b* communicates with the timing hole 17 and the oil guiding groove 15, which prevents drastic discharge of pressure oil from the cylinder bore 4 to the discharge port 9.

Figure 3:
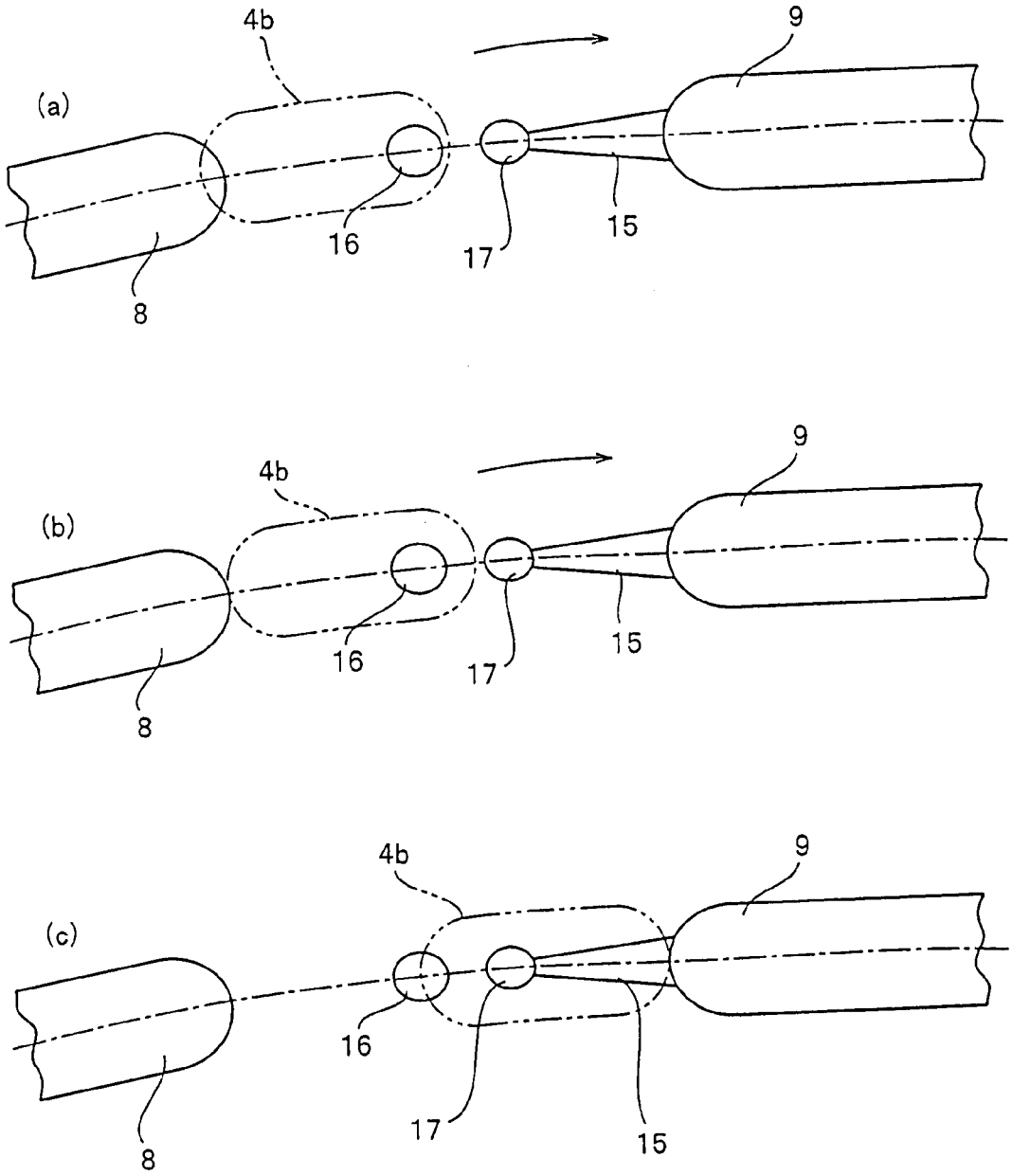
FIG. 3 are plan views of a principal part of the valve plate (First embodiment).

FIGS. 3(*a*) to 3(*c*) sequentially show positional relationships among the cylinder port 4*b* as indicated by dotted lines, the absorption port 8, the through hole 16, the timing hole 17, the oil guiding groove 15, and the discharge port 9, in correspondence to movement positions of the cylinder port 4*b*. The state between FIG. 3(*b*) and FIG. 3(*c*) is the state in which the piston 5 in FIG. 2 is at 5*b*. The through hole 16 can be formed in an area where the cylinder port 4*b* slides as shown in FIGS. 3(*a*) to 3(*c*).

When as shown in FIG. 3(*a*), the cylinder port 4*b* moves to a state in which it communicates with the absorption port 8 and the through hole 16, the pressure of the first pressure chamber 20*a* of the balance valve 20 in FIG. 2 decreases to the pressure of the absorption port 8. Consequently, the balance piston 21 of the balance valve 20 is allowed to be returned to a position at which the first pressure chamber 20*a* is compressed, so that this position becomes an initial position.

When as shown in FIG. 3(*b*), the cylinder port 4*b* stops communicating with the absorption port 8 so that the cylinder bore 4 enters the pre-compression section, the piston 5 in the cylinder bore 4 (see FIG. 2) enters a compression stroke to allow the chamber pressure in the cylinder bore 4 to increase. At this time, the through hole 16 communicates with the cylinder port 4*b*, so that the pressure of the first pressure chamber 20*a* of the balance valve 20 in FIG. 2 becomes equal to the chamber pressure Pi.

When the chamber pressure Pi becomes higher than the system pressure Po of the discharge port 9 by the compression stroke of the piston 5, the balance piston 21 of the balance valve 20 is allowed to slide to the right direction of FIG. 2. This enables to equilibrate the pressure of the first pressure chamber 20*a*, that is, the chamber pressure Pi to the pressure of a second pressure chamber 20*b*, that is, the system pressure Po.

As shown in FIG. 3(*c*), in the state in which the pressure of the first pressure chamber 20*a*, that is, the chamber pressure Pi is equilibrated to the pressure of the second pressure chamber 20*b*, that is, the system pressure Po, the cylinder port 4*b* communicates with the timing hole 17 and the oil guiding groove 15. This allows the chamber pressure Pi in the cylinder bore 4 to be discharged smoothly into the discharge port 9.

Figure 4:
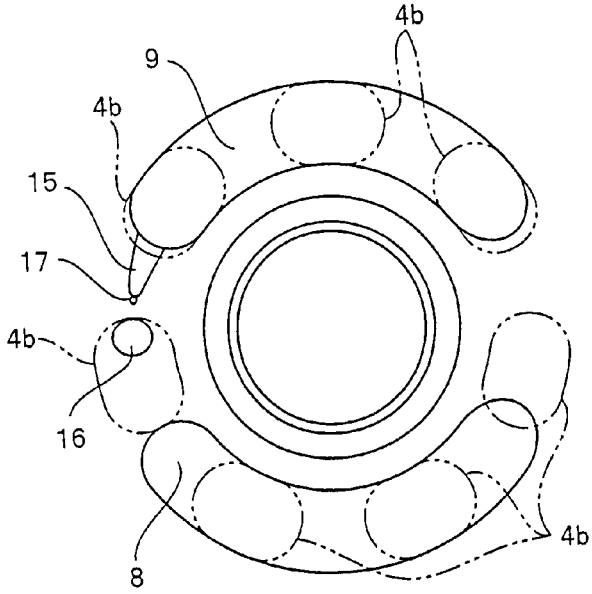
FIG. 4 is a plan view of the valve plate (First embodiment).

FIG. 4 shows a plan view of the valve plate 7, the figure illustrating a positional relationship among the through hole 16, the timing hole 17, the oil guiding groove 15, and the discharge port 9. An arc-shaped port as indicated by dotted lines designates the cylinder port 4*b*. The shape of the cylinder port 4*b* may be an elliptic shape, a circle shape, or the like, other than the arc shape. Although the example of the drawing shows an example in which seven cylinder bores 4 are formed in the cylinder block 3, the number of the cylinder bores 4 formed is not limited to seven, and a proper number of cylinder bores may be formed.

The through hole 16 may be formed on a portion of a valve plate which can communicate with the end of the oil guiding groove 15 or the timing hole 17 through the cylinder port 4*b* in the pre-compression section. For example, the through hole 16 may be formed on a portion which communicates with the end portion of the oil guiding groove 15 or the timing hole 17 or may be formed on a portion which is spaced apart from the end of the oil guiding groove 15 or the timing hole 17.

By allowing the through hole 16 to communicate with the end of the oil guiding groove 15 or the timing hole 17 through the cylinder port 4*b*, the chamber pressure Pi in the cylinder bore 4*b* and the system pressure Po in the discharge port 9 can be in an equilibrated condition until the cylinder port 4*b* communicates with the end of the oil guiding groove 15 or the timing hole 17.

Figure 5:
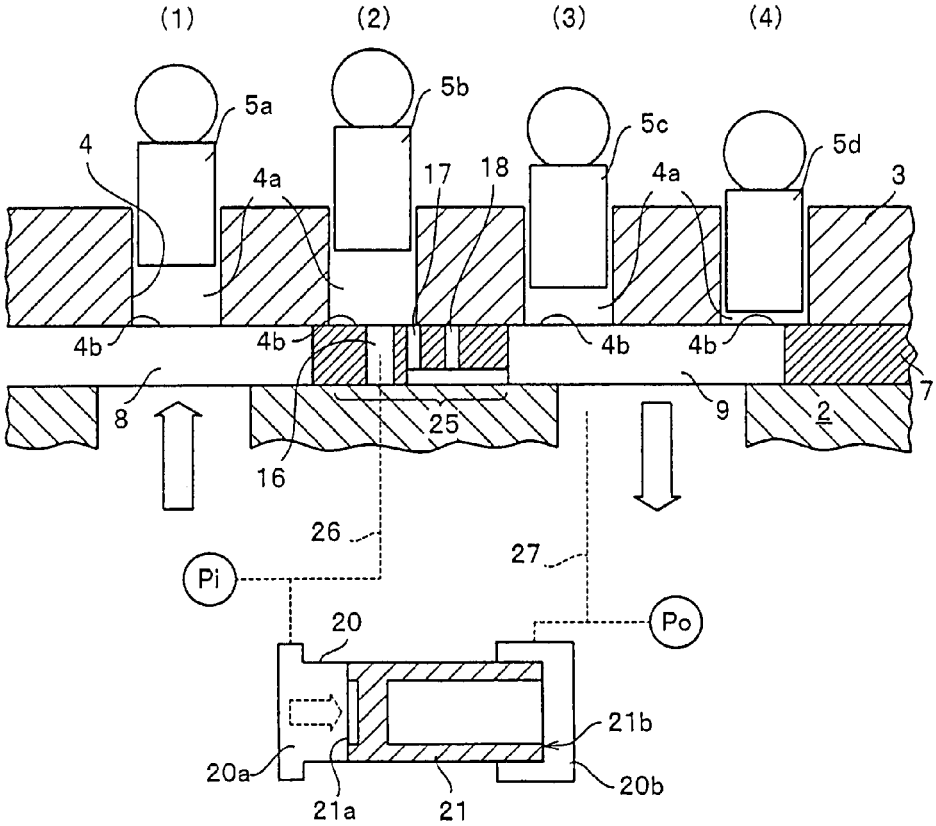
FIG. 5 is a developed view of a valve plate and a cylinder block in which a timing hole is formed (First embodiment).
Figure 6:
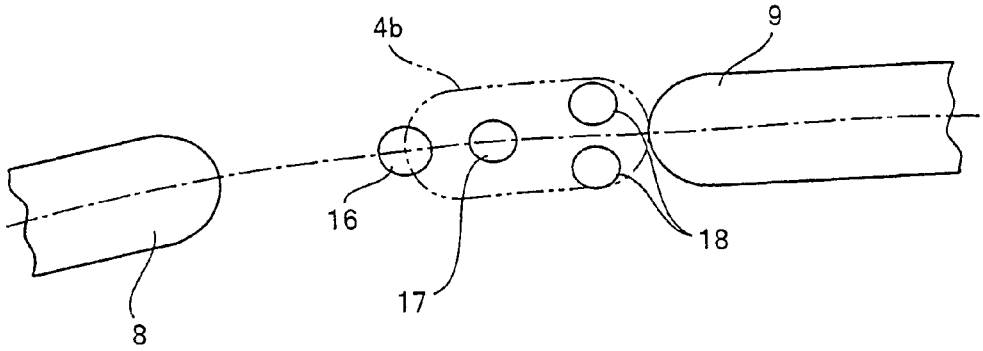
FIG. 6 is a plan view of a principal part of the valve plate in FIG. 5 (First embodiment).

As shown in FIGS. 5 and 6, an oil guiding groove 18 may be formed instead of the oil guiding groove 15. At least one or more of the oil guiding grooves 18 can be formed, and FIGS. 5 and 6 show one example in which one timing hole 17 and two oil guiding grooves 18 are formed. The timing hole 17 and the oil guiding grooves 18 can be formed on the valve plate 7 by forming a drilled hole or the like. The lower end portion of the oil guiding groove 18 communicates with the discharge port 9 through a communication groove or the like.

In the case where the timing hole 17 is formed as described above, the oil guiding groove 18 can be formed on a portion on an area of the valve plate 7 where the cylinder port 4*b* slides after the cylinder port 4*b* communicates with the timing hole 17 as shown in FIG. 6.

In the case where the timing hole 17 is not formed, the oil guiding groove 18 is needed to be formed at a position where the cylinder port 4*b* communicates with the oil guiding groove 18 at predetermined timing.

Figure 12:
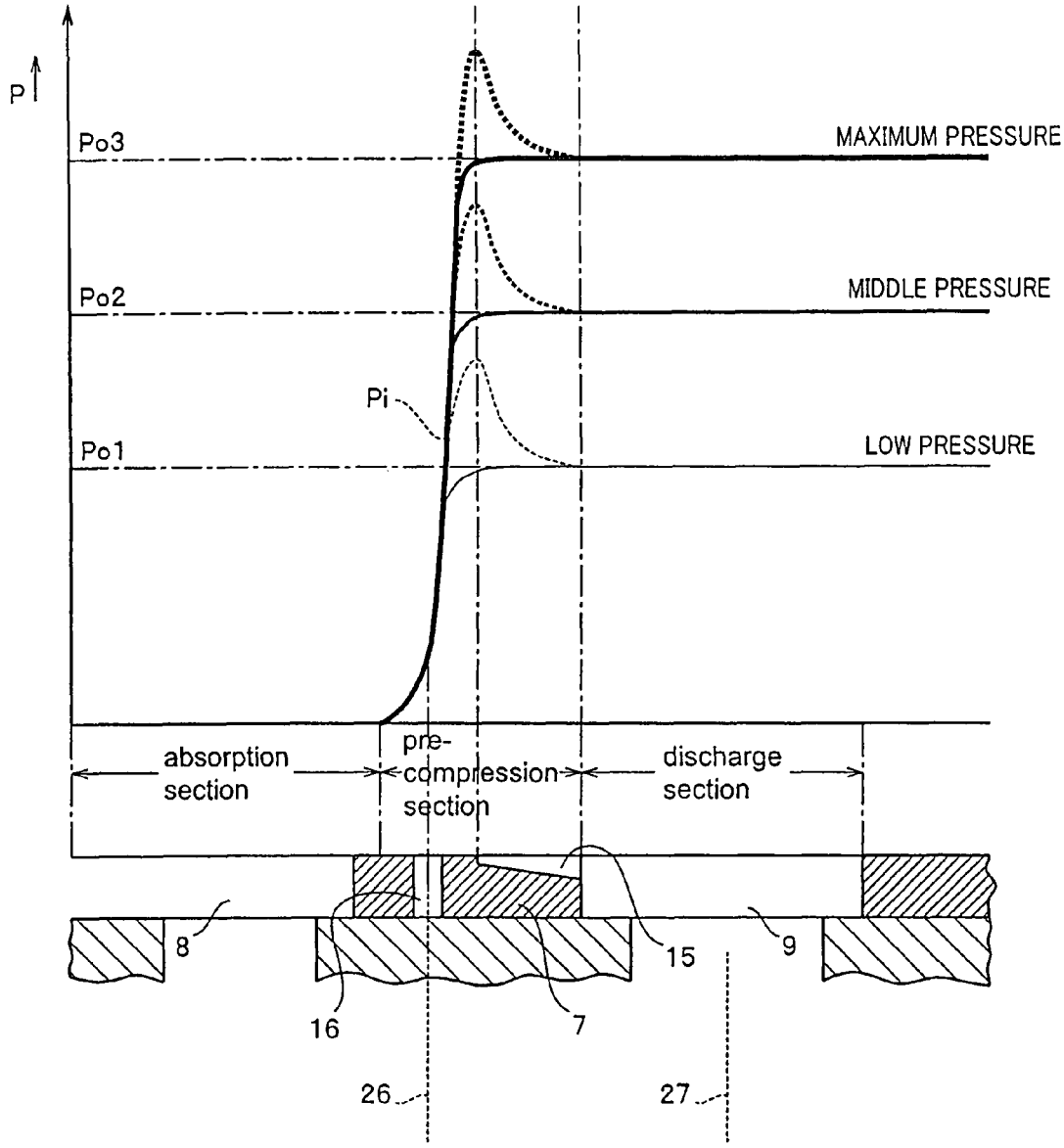
FIG. 12 is a view for explaining relationships between a chamber pressure and a system pressure (explanatory example).

FIG. 12 is an explanatory view regarding a case where the chamber pressure Pi in the cylinder bore 4 can be increased to pressures set in the hydraulic circuit in the pre-compression section. The vertical axis represents the pressures of the chamber pressure Pi and the system pressure Po in the cylinder bores 4, and the horizontal axis represents rotation angle positions of the cylinder bore 4.

The solid lines represent the relationship between the chamber pressure Pi and the rotation angle position of the cylinder bore 4 in the case where the through hole 16 and the balance valve 20 are provided according to the present invention, and dotted lines represent the relationship between the chamber pressure Pi and the rotation angle position of the cylinder bore 4 in the case where the through hole and the balance valve are not provided.

In general, a maximum pressure discharged from the hydraulic piston pump is controlled by a relief valve arranged in the hydraulic circuit which couples the discharge port 9 with the hydraulic system, actuator, or the like. FIG. 12 will be explained exemplifying the thickest solid line and dotted lines which represent an exemplified case where the chamber pressure Pi in the cylinder bore 4 which increases in the pre-compression section becomes the maximum pressure.

When the cylinder port 4*b* of the cylinder bore 4 passes through an absorption section to enter the pre-compression section, the piston 5 of the cylinder bore 4 (see FIG. 2) enters the compression stroke, so that the chamber pressure Pi in the cylinder bore 4 increases. For this reason, in the case where the through hole 16 and the balance valve are not provided, the chamber pressure Pi increases to a peak pressure state at which it exceeds the system pressure Po as shown by the thickest solid line.

The pressure of the cylinder bore 4 becomes a pressure obtained by adding a pressure loss part for passing through the timing hole 17, the oil guiding groove 15, and the like to the system pressure Po. Accordingly, in a case where the system pressure Po is at a high pressure, a middle pressure, or a low pressure, a pressure obtained by adding a pressure loss part for passing through the timing hole 17, the oil guiding groove 15, and the like to each pressure is generated in the cylinder bore 4. As the opening area of the oil guiding groove 15 increases, the pressure of the cylinder bore 4 reaches the system pressure Po and becomes equilibrated to it.

In the present invention, on the other hand, the through hole 16 and the balance valve 20 (not shown) are provided. With this configuration, the chamber pressure Pi gradually reaches the system pressure Po3 and can be equal to the system pressure Po3 in accordance with the smooth curve as shown by the thickest solid line.

That is, when the cylinder port 4*b* communicates with the through hole 16 which communicates with the one end surface side of the unillustrated balance valve through the first oil path 26, the chamber pressure Pi in the cylinder bore 4 is regulated so as to be equilibrated to the system pressure Po3.

Thus, when the cylinder port 4*b* communicates with the oil guiding groove 15, the chamber pressure Pi in the cylinder bore 4 and the system pressure Po3 become in an approximately equal pressure state, thereby preventing generation of peak pressures between the places inside the cylinder bore 4 and the discharge port 9. Accordingly, pressure oil inside the cylinder bore 4 can be smoothly discharged from the discharge port 9.

The discharge pressure of the hydraulic piston pump is determined by the load pressure, and Po2 and Po1 denote cases where the system pressures are the middle pressure and the low pressure, respectively. In FIG. 12, the cases where the system pressures are the middle pressure and the low pressure correspond to curves denoted by the secondary thicker solid line and dotted lines and the thinnest solid line and dotted lines.

In this case, peak pressures are generated with respect to the system pressures as denoted by dotted lines in the case where the through hole 16 and the unillustrated balance valve 20 are not provided, although in the respective cases the same rising curve as the rising curve of the chamber pressure Pi are drawn. The respective peak pressures are generated immediately before the cylinder port 4*b* communicates with the oil guiding groove 15.

In this way, when the through hole 16 and the unillustrated balance valve 20 are provided, as shown by solid lines, from a rotation angle position of the cylinder bore 4 where the cylinder port 4*b* of the cylinder bore 4 communicates with the through hole 16, the chamber pressure Pi is allowed to smoothly, gradually reach the system pressure Po3 of the maximum pressure, the system pressure Po2 of the middle pressure, or the system pressure Po1 of the low pressure, and becomes equal to the system pressure.

That is, the balance piston 21 in the balance valve 20 slides such that the chamber pressure Pi is equilibrated to the system pressure Po, so that the chamber pressure Pi and the system pressure Po can be equilibrated.

As described above, in the prior art in which the balance valve 20 is not employed, also when the system pressure Po is the middle pressure and the low pressure which are lower than the maximum pressure, the chamber pressure Pi overshoots the respective pressures to generate peak pressures as shown by dotted lines in FIG. 12, similarly to the case where it is the maximum pressure.

In the present invention, on the other hand, as shown by solid lines of FIG. 12, the chamber pressure Pi in the cylinder bore 4 can be in an equilibrium condition to the system pressure Po by means of the balance valve 20 via the through hole 16. Accordingly, even when the cylinder port 4*b* communicates with the oil guiding groove 15 and the like, overshooting does not occur, and such an equal pressure state to the system pressure Po can be obtained as shown by the solid lines.

The through hole 16 may be formed separately from the timing hole 17. Or, it can be formed as a through hole which utilizes the timing hole 17.

Thus, in the present invention, the volumes of the respective pressure chambers in both end portion sides of the balance piston 21 are changed by sliding of the balance piston 21, and a pressure difference part generated between the chamber pressure Pi and the system pressure Po can be absorbed.

Thus, in the state in which the cylinder port 4*b* communicates with the discharge port 9 through the oil guiding groove 15 or the timing hole 17, the chamber pressure Pi in the cylinder bore 4 can be equilibrated to the system pressure Po in the discharge port 9. This makes it possible to prevent generation of backflow of pressure oil from the discharge port 9 to the part inside the cylinder bore 4 and/or drastic flowing of pressure oil from the cylinder bore 4 to the discharge port 9.

Accordingly, pulsating of pressure oil between the cylinder bore 4 and the discharge port 9 is decreased to reduce generation of noise and vibration due to the hydraulic piston pump.

Further, the chamber pressure Pi in the cylinder bore 4 and the system pressure Po in the discharge port 9 are equilibrated employing the balance valve 20. Therefore, even when the system pressure Po required by a hydraulic system, an actuator, or the like is changed due to operation of the hydraulic system, the actuator, or the like, the chamber pressure Pi and the system pressure Po are in an equilibrium condition when the cylinder port 4*b* communicates with the oil guiding groove 15 or the timing hole 17.

Moreover, the volumes of the respective pressure chambers at both ends of the balance piston 21 are changed by sliding of the balance piston 21 in order to absorb the pressure difference part. Therefore, even when the cylinder block 3 rotates at high speed, the volumes can be changed as described above, following the high speed rotation. Consequently, even when the rotational speed of the hydraulic piston pump is changed, the chamber pressure Pi in the cylinder bore 4 can be constantly prevented from overshooting with respect to the system pressure Po.

The balance valve 20 may be arranged on the outside of the hydraulic piston pump or may be constructed integrally with the hydraulic piston pump. In the case where the balance valve 20 is arranged on the outside of the hydraulic piston pump, attachment work of the balance valve 20 can be implemented conveniently, and repair and inspection of the balance valve 20 can also be implemented easily.

Second Embodiment

Figure 7:
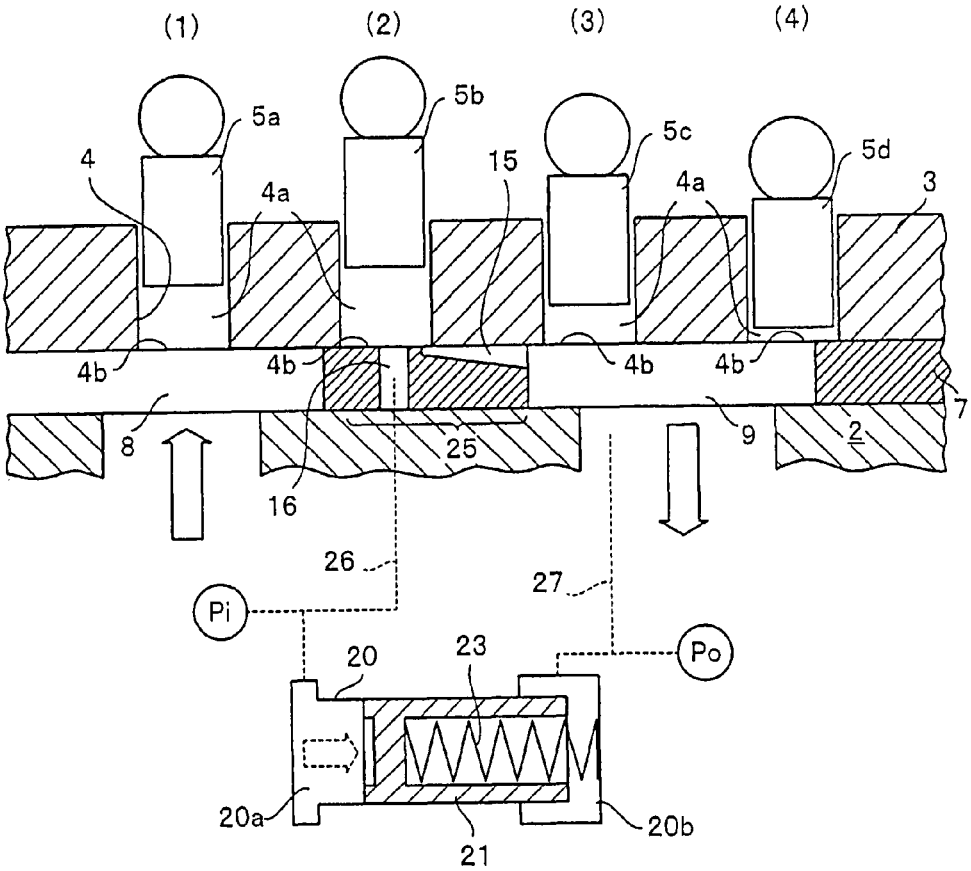
FIG. 7 is a developed view of a valve plate and a cylinder block (Second embodiment).

FIG. 7 shows a block diagram in which a spring is arranged in order to return the balance piston of the balance valve to an initial position and in which a timing hole is not formed on the valve plate 7. A second embodiment shows a modified example of the balance valve 20. In the second embodiment, the constitution in which a spring is arranged inside the balance valve 20 in order to return the balance piston to the initial position is provided, and it is different from the constitution of the balance valve 20 of the first embodiment.

The constitution of the second embodiment has a constitution similar to that of the first embodiment other than that in which the timing hole is not formed on the valve plate 7. The constitution in which a spring is arranged in order to return the balance piston 21 to the initial position will be mainly described below. With respect to constituent members other than the balance valve 20, the same reference numerals as those employed in the first embodiment are employed, and description for constitutions and operations of the constituent members will be omitted.

Figure 9:
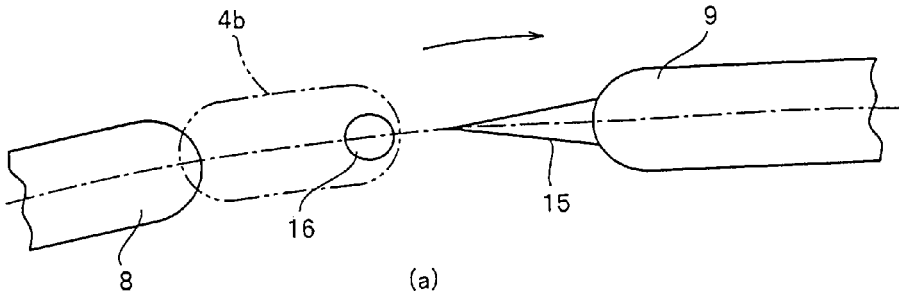
FIG. 9 are plan views of a principal part of the valve plate (Second embodiment).
Figure 9:
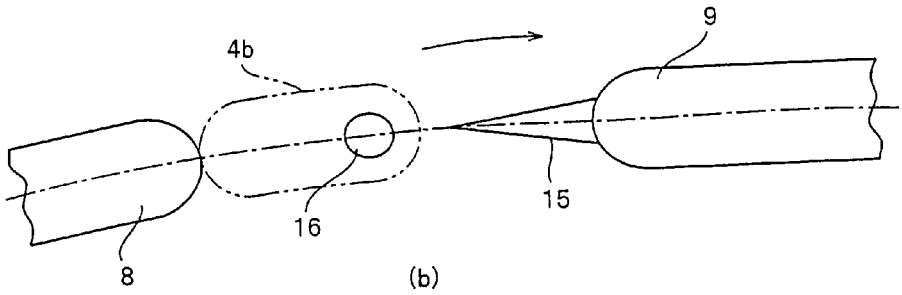

FIGS. 9(*a*) and 9(*b*) show arrangement relationships of main parts of the cylinder port 4*b* on the plane surface of the valve plate 7 and the valve plate 7 in the second embodiment. As shown in FIG. 9(*a*), the cylinder port 4*b* moves to an arrow direction in response to a movement of the cylinder block 3. At this time, the cylinder port 4*b* moves from a state in which it communicates only with the absorption port 8 to a state in which it communicates with the through hole 16 and the absorption port 8.

At this time, the pressure of the first pressure chamber 20*a* is the pressure of the absorption port 8. When the system pressure Po affecting the second pressure chamber 20*b* and the pressure affecting the first pressure chamber 20*a* are in an equilibrium condition, the balance piston 21 can be returned to the initial position at which the volume of the first pressure chamber 20*a* is decreased by the pressure difference between both end surfaces of the balance piston 21 and the spring force of a spring 23.

When the cylinder block 3 moves so that the cylinder port 4*b* enters the pre-compression section 25, the pressure inside the cylinder bore 4 becomes the chamber pressure Pi which is increased by the pre-compression process. As shown in FIG. 9(*b*), when the communication with the absorption port 8 is shut off so that the cylinder port 4*b* enters the pre-compression section 25 to communicate with the through hole 16, the pressure of the first pressure chamber 20*a* becomes an increased chamber pressure Pi.

When the chamber pressure Pi supplied to the first pressure chamber 20*a* becomes greater than a summed force of the system pressure Po and the bias force of the spring 23, the balance piston 21, while compressing the spring 23, slides the second pressure chamber 20*b* to a direction in which it is compressed. When the chamber pressure Pi of the first pressure chamber 20*a* and the system pressure Po of the second pressure chamber 20*b* are in an equilibrium condition, the balance piston 21 returns to the initial position side in which the volume of the first pressure chamber 20*a* is decreased by the spring force of the spring 23.

With respect to the bias force of the spring 23, it can be sufficient if it has a spring force by which the balance piston 21 is slid in the direction in which the first pressure chamber 20*a* is compressed when the pressure of the first pressure chamber 20*a* and the system pressure Po of the second pressure chamber 20*b* are in the equilibrium condition. It is not needed that the bias force is set to a spring force imparting a special high bias force. Thus, with sliding of the balance piston 21 in the balance valve 20, the chamber pressure Pi in the first pressure chamber 20*a* can be controlled so as to be approximately the system pressure Po.

A spring having a spring force equal to the force of the spring 23 arranged on the second pressure chamber 20*b* may be further arranged on the first pressure chamber 20*a*. In this case, at the middle position of the balance valve 20, the pressure of the first pressure chamber 20*a* and the system pressure Po of the second pressure chamber 20*b* are in the equilibrium condition. The middle position of the balance valve 20 at this time can be constructed so as to be the initial position of the balance piston 21.

Figure 8:
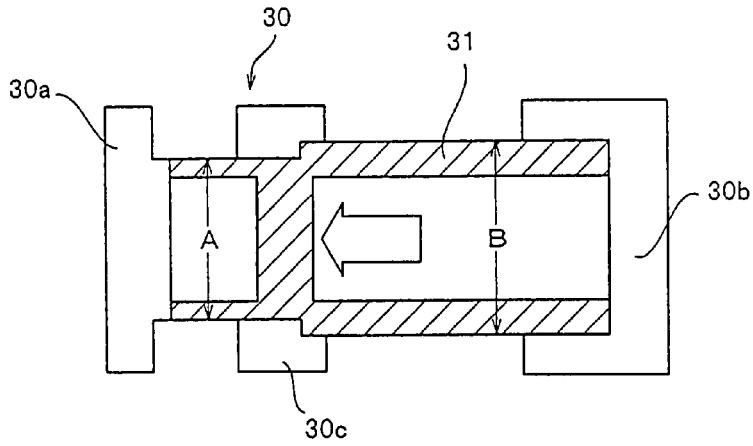
FIG. 8 is a schematic cross-sectional view showing a modified example of a balance valve (Second embodiment).

As shown in FIG. 8, instead of arranging the spring 23, a constitution may be adopted in which an area difference is provided between pressure receiving areas of a first pressure chamber 30*a* and a balance piston 31 in the second pressure chamber 30*b*. In FIG. 8, a pressure receiving area A of the balance piston 31 in the first pressure chamber 30*a* is set to an area smaller than a pressure receiving area B in the second pressure chamber 30*b*, and a third pressure chamber 30*c* communicating with a tank is constructed between the first pressure chamber 30*a* and the second pressure chamber 30*b*.

In this case, when the chamber pressure Pi in the cylinder bore 4 becomes higher than the system pressure Po in the pre-compression section, the balance piston 31 can be operated effectively. When the first pressure chamber 30*a* and the second pressure chamber 30*b* are in an equilibrium condition after operation, the pressure of the third pressure chamber 30*c* is a tank pressure. Consequently, the balance piston 31 can be returned to the initial position at which the volume of the first pressure chamber 30*a* is decreased by the pressure receiving area difference between the first pressure chamber 30*a* and the second pressure chamber 30*b*.

When the chamber pressure Pi in the cylinder bore 4 becomes lower than the system pressure Po in the pre-compression section 25, the pressure receiving area A of the first pressure chamber 30*a* can be larger than the pressure receiving area B in the second pressure chamber 30*b*.

As the state of (2) in FIG. 7, when the cylinder port 4*b* communicates with the oil guiding groove 15, the chamber pressure Pi in the cylinder bore 4 is approximately equal to the system pressure Po in the discharge port 9. Thus, pressure oil inside the cylinder bore 4 can be discharged smoothly from the discharge port 9 without generating a peak pressure between the cylinder port 4*b* and the discharge port 9.

As described in the first embodiment, the timing hole 17 may be formed instead of the oil guiding groove 15.

Thus, in the state in which the cylinder port 4*b* enters the pre-compression section so as to communicate with the oil guiding groove 15 or the timing hole 17 or the discharge port 9, the balance piston 21 can be returned to the initial position that is the operation starting position to dissolve the pressure difference between the chamber pressure Pi in the cylinder bore 4 and the system pressure Po in the discharge port 9.

Third Embodiment

Figure 10:
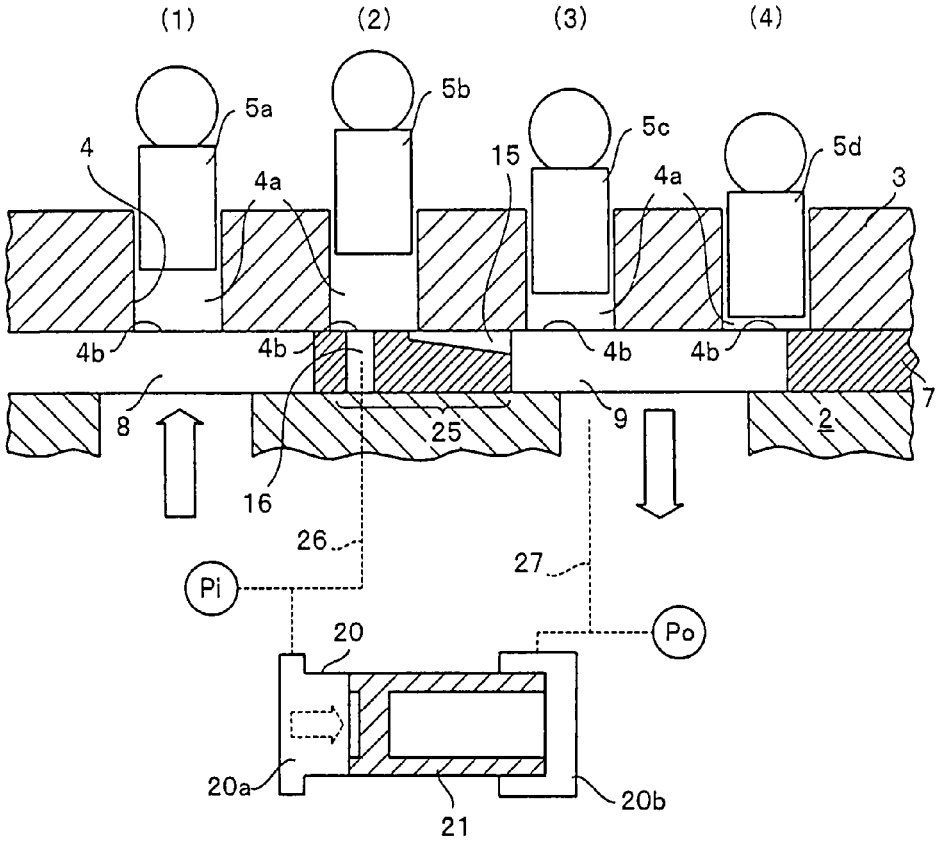
FIG. 10 is a developed view of a valve plate and a cylinder block (Third embodiment).

FIG. 10 is a block diagram showing an example in which the through hole 16 is formed on a portion on which it communicates with the cylinder port 4*b* when the piston 5 becomes immediately before the bottom dead center. FIG. 9 is also employed for supporting explanation, since a principal part view obtained by viewing the arrangement relationship on the plane surface of the valve plate 7 corresponds to views similar to FIG. 9 in the second embodiment.

A third embodiment has a constitution in which a spring is not arranged in the balance valve 20 as shown in FIG. 10, which is different from the balance valve 20 shown in FIG. 7 of the second embodiment. That is, in the second embodiment, as shown in FIGS. 7 and 8, as a constitution for returning the balance piston 21 to the initial position, provided is the constitution in which the spring 23 is arranged in the second pressure chamber 20*b* or the constitution in which the area difference in pressure receiving areas of the balance piston 21 is provided between the first pressure chamber 20*a* and the second pressure chamber 20*b*.

The third embodiment has a constitution in which the pressure of the first pressure chamber 20*a* is decreased to return the balance piston 21 to the initial position by allowing the through hole 16 to communicate with the absorption port 8 through the cylinder port 4*b*.

Other constitutions are similar to those in the second embodiment. The constitution in which the balance piston 21 is returned to the initial position will be mainly described below, and the same reference numerals as those employed in the first and second embodiments are employed, so that description regarding those members will be omitted.

While an example in which the oil guiding groove 15 is formed will be described in the third embodiment, an oil guiding tube may be formed instead of the oil guiding groove 15. In a case where the oil guiding tube is formed without forming a timing hole, similarly to cases described in the first and second embodiments, it is desired that the oil guiding tube is formed such that the oil guiding tube and the cylinder port 4*b* communicate with each other at predetermined timing.

As shown in FIG. 9(*a*), the cylinder port 4*b* moves to the arrow direction in response to the movement of the cylinder block 3. At this time, the cylinder port 4*b* moves from a communication state in which it communicates only with the absorption port 8 to a state in which the through hole 16 and the absorption port 8 are allowed to communicate with each other.

By allowing the through hole 16 and the absorption port 8 to communicate with each other, the pressure of the first pressure chamber 20*a* becomes the pressure of the absorption port 8. Thus, the pressure of the absorption port 8 which is lower than the system pressure Po affecting the second pressure chamber 20*a* affects the first pressure chamber 20*a*. As a consequence, the balance piston 21 can be returned to the initial position at which the volume of the first pressure chamber 20*a* is decreased.

When the cylinder block 3 moves so that the cylinder port 4*b* enters the pre-compression section 25 shown in FIG. 10, the pressure in the cylinder bore 4 becomes the chamber pressure Pi in the pre-compression process. As shown in FIG. 9(*b*), when communication with the absorption port 8 is shut off so that the cylinder port 4*b* enters the pre-compression section 25 to thereby allow the cylinder port 4*b* to communicate with the through hole 16, the pressure of the first pressure chamber 20*a* becomes an increased chamber pressure Pi.

When the chamber pressure Pi supplied to the first pressure chamber 20*a* is greater than the system pressure Po, the balance piston 21 slides in the direction in which the second pressure chamber 20*b* is compressed. When the chamber pressure Pi of the first pressure chamber 20*a* and the system pressure Po of the second pressure chamber 20*b* are in an equilibrium condition, sliding of the balance piston 21 is stopped. Thus, the pressure of the first pressure chamber 20*a*, that is, the chamber pressure Pi of the cylinder bore 4*a*, can be equilibrated to the system pressure Po of the second pressure chamber 20*b*.

Even when the chamber pressure Pi in the cylinder bore 4 is increased in the pre-compression section 25, the balance piston 21 of the first pressure chamber 20*a* is slid by an increased chamber pressure Pi since the through hole 16 is in a state in which it communicates with the cylinder port 4*b*. Thus, the equilibrium condition of the chamber pressure Pi and the system pressure Po can be maintained.

The cylinder port 4*b* can communicate with the oil guiding groove 15 while this equilibrium condition is maintained as shown in (2) of FIG. 10. The through hole 16 can maintain a communication state with the cylinder port 4*b* until the cylinder port 4*b* communicates with the timing hole 17 and the oil guiding groove 15. Thus, discharge of pressure oil from the cylinder port 4*b* to the oil guiding groove 15 and the discharge port 9 can be executed smoothly without generating a peak pressure.

Figure 11:
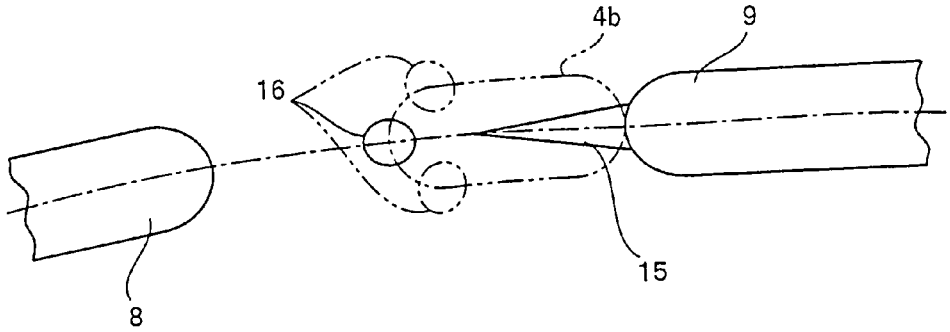
FIG. 11 is a plan view of a principal part of the valve plate (Third embodiment).

FIGS. 9 and 10 show an example in which the timing hole 17 is not formed. In this case, as shown in FIG. 11, even when the cylinder port 4*b* communicates with the oil guiding groove 15, the through hole 16 is needed to be formed at a portion at which the through hole 16 and the cylinder port 4*b* maintain the communication state.

Fourth Embodiment

Figure 13:
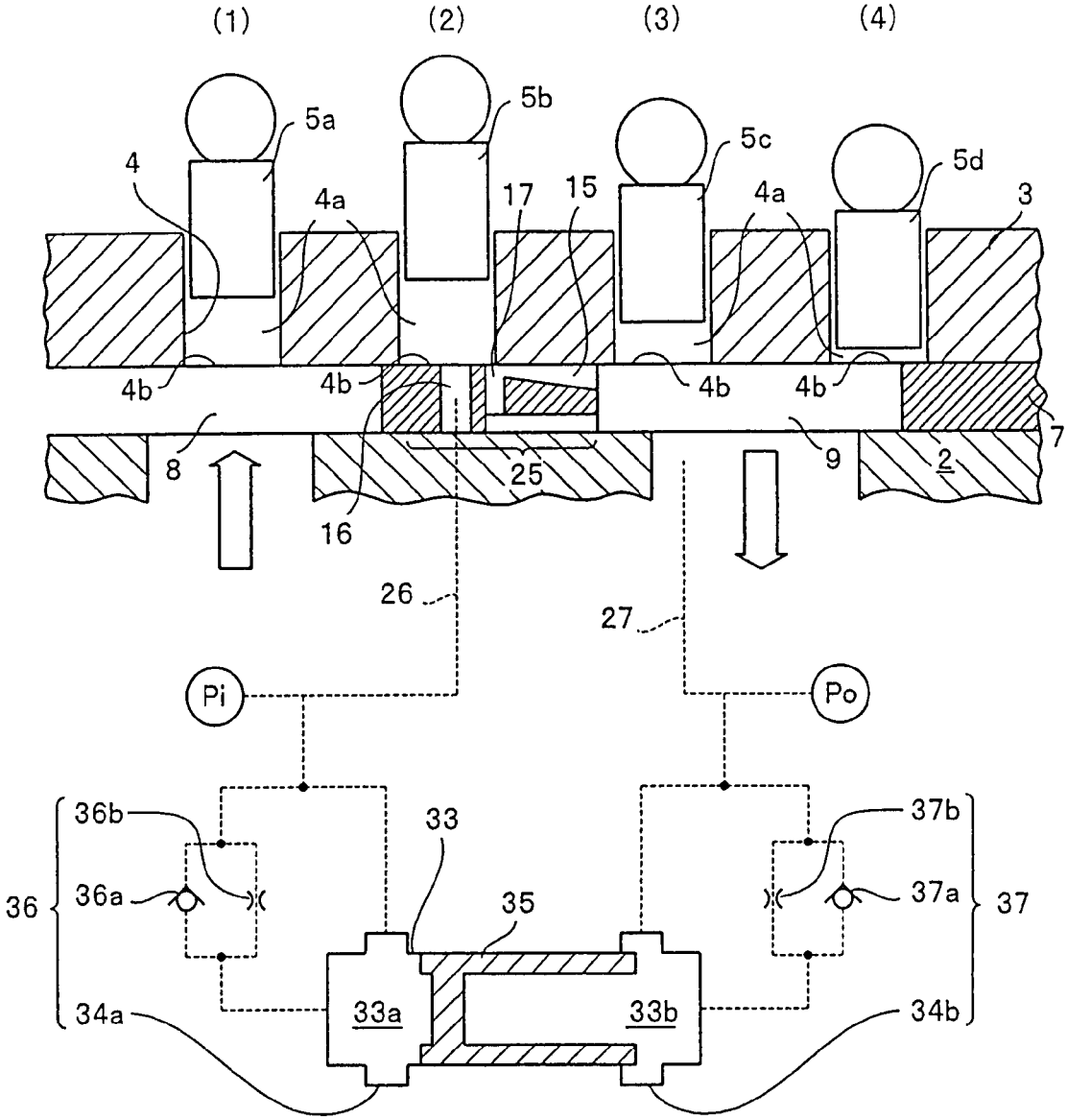
FIG. 13 is a developed view of a valve plate and a cylinder block (Fourth embodiment).
Figure 14:
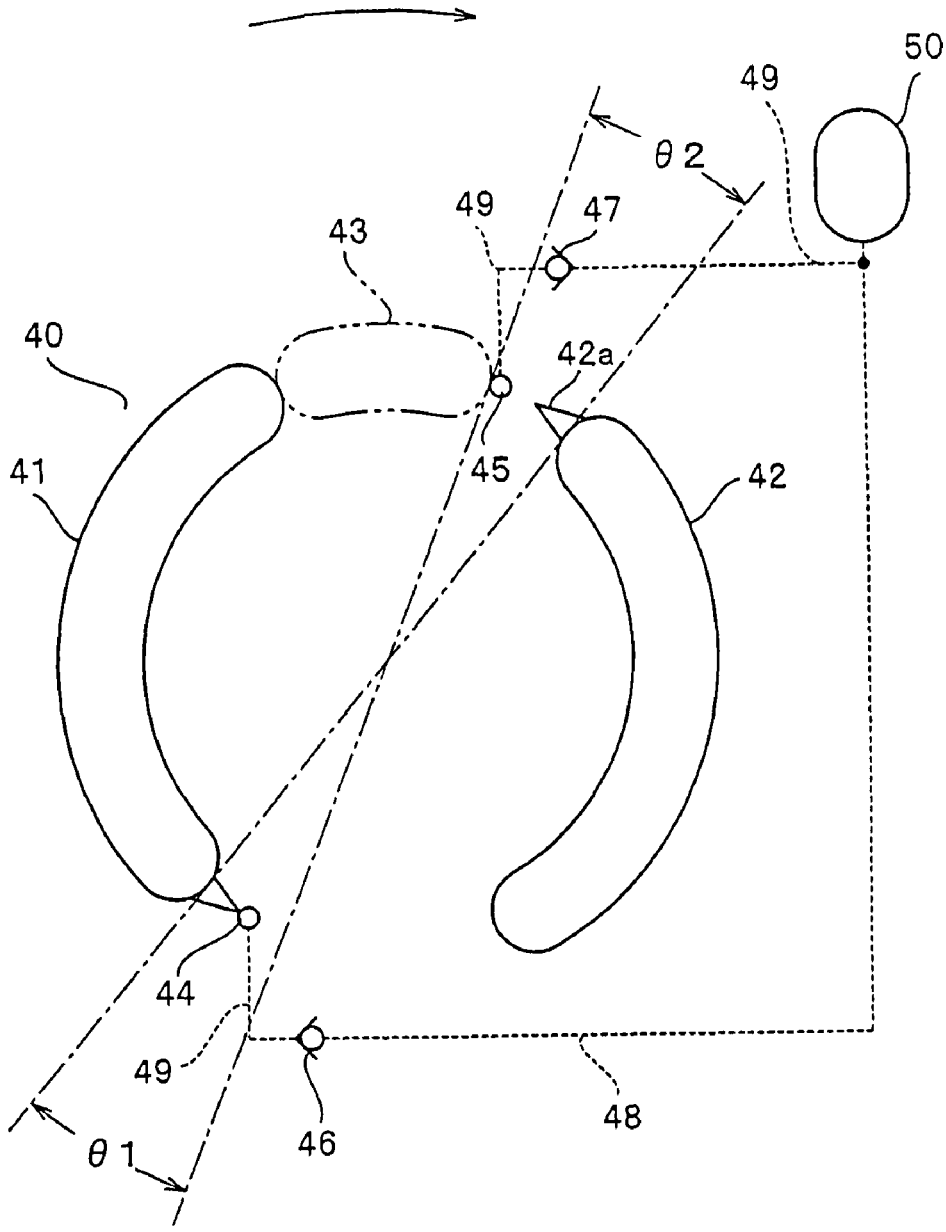
FIG. 14 is a view for explaining operations of a valve plate (conventional example 1).
Figure 15:
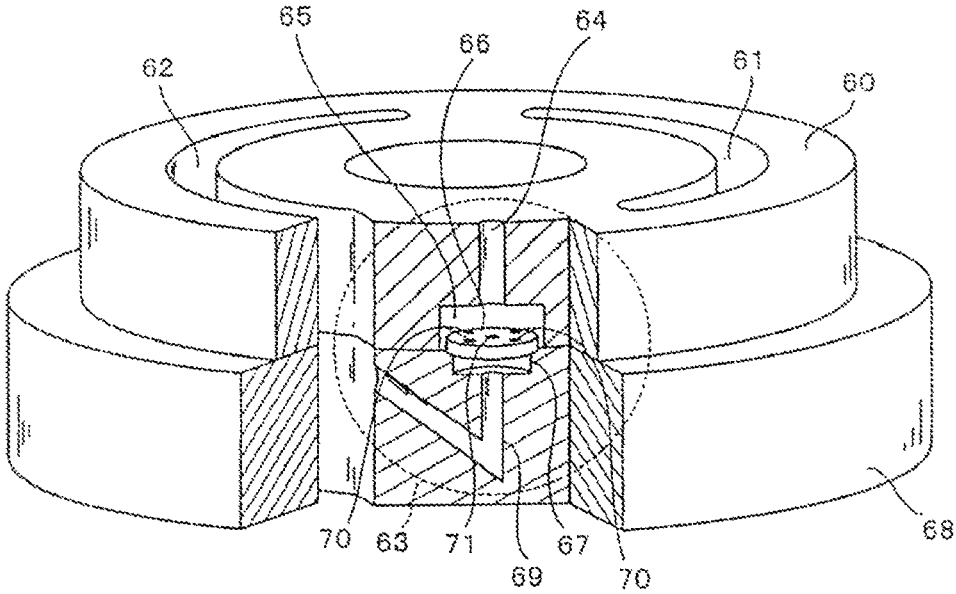
FIG. 15 is a perspective view partly broken away and sectioned of a valve plate (conventional example 2).

A fourth embodiment shown in FIG. 13 has a constitution in which damper mechanisms 36, 37 are arranged on respective end surfaces of a balance valve 33. To construct the damper mechanisms 36, 37, a pair of ring-shaped grooves 34*a*, 34*b* are formed on the inner circumferential surface of the balance valve 33. A balance piston 35 sliding inside the balance valve 33 enables to selectively perform communication and shut-off between the ring-shaped groove 34*a* and the first pressure chamber 33*a* and communication and shut-off between the ring-shaped groove 34*b* and the second pressure chamber 33*b*.

The ring-shaped groove 34*a* communicates with the through hole 16 through the first oil path 26, and the first pressure chamber 33*a* communicates with the first oil path 26 through a check valve 36*a* and a throttle 36*b* arranged in parallel. The ring-shaped groove 34*b* communicates with the discharge port 9 through the second oil path 27, and the second pressure chamber 33*b* communicates with the second oil path 27 through a check valve 37*a* and a throttle 37*b* arranged in parallel.

A damper mechanism 36 arranged in the first pressure chamber 33*a* side is composed of the ring-shaped groove 34*a*, the check valve 36*a*, and the throttle 36*b*, and the damper mechanism 37 arranged in the second pressure chamber 33*b* side is composed of the ring-shaped groove 34*b*, the check valve 37*a*, and the throttle 37*b*.

Next, operations of the damper mechanisms 36, 37 will be described. When the cylinder port 4*b* of the cylinder bore 4 communicates with the through hole 16 in the pre-compression section 25, the chamber pressure Pi is introduced into the first pressure chamber 33*a*, and the balance piston 35 slides in a direction in which the chamber pressure Pi and the system pressure Po in the discharge port 9 are balanced.

At this time, when the balance piston 35 slides in a direction in which the volume of the second pressure chamber 33*b* is decreased, pressure oil of the second pressure chamber 33*b* flows into the discharge port 9 through the ring-shaped groove 34*b*. When the balance piston 35 further slides, a communication state between the ring-shaped groove 34*b* and the second pressure chamber 33*b* are shut off by means of the balance piston 35. When the communication state between the ring-shaped groove 34*b* and the second pressure chamber 33*b* is shut off, pressure oil in the second pressure chamber 33*b* flows into the discharge port 9 through the throttle 37*b*.

That is, a damper function for the balance piston 35 in the second pressure chamber 33*b* side is produced by the operation of the throttle 37*b*.

Further, even if the communication state between the ring-shaped groove 34*a* and the first pressure chamber 33*a* is shut of f by means of the balance piston 35 when the balance piston 35 starts sliding in the direction in which the volume of the second pressure chamber 33*b* is decreased, the cylinder port 4*b* of the cylinder bore 4 can communicate with the first pressure chamber 33*a* through the check valve 36*a*. Consequently, the actuation of the balance piston 35 can be implemented quickly.

When the through hole 16 communicates with the absorption port 8, the pressure of the first pressure chamber 33*a* becomes the pressure of the absorption port 8, and the balance piston 35 can be returned to the initial position at which the volume of the first pressure chamber 33*a* is decreased.

At this time, when the balance piston 35 slides in the direction in which the volume of the first pressure chamber 33*a* is decreased so that the communication state between the ring-shaped groove 34*a* and the first pressure chamber 33*a* is shut off by means of the balance piston 35, the pressure oil in the first pressure chamber 33*a* flows into the absorption port 8 through the throttle 36*b* via the through hole 16.

Thus, a damper function for the balance piston 35 in the first pressure chamber 33*a* side is produced by the operation of the throttle 36*b*.

Further, even if the communication state between the ring-shaped groove 34*b* and the second pressure chamber 33*b* is shut off by means of the balance piston 35 when the balance piston 35 starts sliding in the direction in which the volume of the first pressure chamber 33*a* is decreased, the discharge port 9 can communicate with the second pressure chamber 33*b* through the check valve 37*a*. As a consequence, the actuation of the balance piston 35 can be implemented quickly.

The invention claimed is:

1. A hydraulic piston pump with a balance valve, the hydraulic piston pump comprising:

a valve plate having an absorption port and a discharge port which communicate with an absorption path and a discharge path of a pump case, respectively;

a cylinder block which slides on the valve plate to rotate;

a plurality of cylinder bores formed in the cylinder block; and pistons which slide in the respective cylinder bores to do reciprocating motion in response to a rotation angle of the respective cylinder bores, wherein the hydraulic piston pump includes:

a through hole formed between the absorption port in the valve plate and a timing hole to introduce a chamber pressure in the cylinder bores, the timing hole is formed in such a way that the chamber pressure in the cylinder bore does not enter the discharge port abruptly;

a first oil path for introducing pressure oil of the chamber pressure from the through hole via the valve plate;

a second oil path for introducing pressure oil of a system pressure from the discharge port; and a balance piston, constructed as a free piston having one end surface that receives the pressure oil from the first oil path and an other end surface that receives the pressure oil from the second oil path, the balance piston being activated in response to a pressure difference between the chamber pressure and the system pressure; and when cylinder ports that are formed at the bottom of a cylinder bore communicate with the absorption port and the through hole, a pressure of a first pressure chamber of the balance valve which slides the balance piston decreases to a pressure of the absorption port and consequently the balance piston returns to an initial position at which the first pressure chamber is compressed.

2. The hydraulic piston pump with a balance valve according to claim 1, wherein the balance piston slides from a side of the one end surface to a side of the other end surface in such a way that the system pressure and the chamber pressure are equilibrated.

3. The hydraulic piston pump with a balance valve according to claim 1, wherein an area difference is formed between the one end surface and the other end surface of the balance piston, wherein the area difference returns the balance piston to the initial position when the chamber pressure guided from the first oil path and the system pressure guided from the second oil path are equilibrated, and that a pressure receiving area of the one end surface is smaller than a pressure receiving area of the other end surface.

4. The hydraulic piston pump with a balance valve according to claim 1, wherein a spring is arranged which returns the balance piston to the initial position when the chamber pressure guided from the first oil path and the system pressure guided from the second oil path are equilibrated, and which biases the balance piston from the side of the other end surface to the side of the one end surface.

5. The hydraulic piston pump with a balance valve according to claim 1, wherein damper mechanisms are formed on respective end surfaces of a balance valve for accommodating the balance piston.

6. The hydraulic piston pump with a balance valve according to claim 2, wherein an area difference is formed between the one end surface and the other end surface of the balance piston, wherein the area difference returns the balance piston to the initial position when the chamber pressure guided from the first oil path and the system pressure guided from the second oil path are equilibrated, and that a pressure receiving area of the one end surface is smaller than a pressure receiving area of the other end surface.

7. The hydraulic piston pump with a balance valve according to claim 2, wherein a spring is arranged which returns the balance piston to the initial position when the chamber pressure guided from the first oil path and the system pressure guided from the second oil path are equilibrated, and which biases the balance piston from the side of the other end surface to the side of the one end surface.

8. The hydraulic piston pump with a balance valve according to claim 2, wherein damper mechanisms are formed on respective end surfaces of a balance valve for accommodating the balance piston.

9. The hydraulic piston pump with a balance valve according to claim 3, wherein damper mechanisms are formed on respective end surfaces of a balance valve for accommodating the balance piston.

10. The hydraulic piston pump with a balance valve according to claim 4, wherein damper mechanisms are formed on respective end surfaces of a balance valve for accommodating the balance piston.

11. The hydraulic piston pump with a balance valve according to claim 6, wherein damper mechanisms are formed on respective end surfaces of a balance valve for accommodating the balance piston.

12. The hydraulic piston pump with a balance valve according to claim 7, wherein damper mechanisms are formed on respective end surfaces of a balance valve for accommodating the balance piston.

* * * * *